US005090274A

United States Patent [19]

Schaub

[11] Patent Number: 5,090,274

[45] Date of Patent: Feb. 25, 1992

[54] OIL FILTER WRENCH

[75] Inventor: Erwin L. Schaub, Jacksonville, Fla.

[73] Assignee: Epicor Industries, Inc., St. Augustine, Fla.

[21] Appl. No.: 657,511

[22] Filed: Feb. 19, 1991

[51] Int. Cl.[5] ..... B25B 13/52

[52] U.S. Cl. ..... 81/64; 81/3.43

[58] Field of Search ..... 81/64, 65, 65.2, 3.43

[56] References Cited

U.S. PATENT DOCUMENTS

| | | | |
|---|---|---|---|
| 824,369 | 6/1906 | Macauley | 81/3.43 |
| 1,916,544 | 7/1933 | Bevington et al. | 81/64 X |
| 3,465,622 | 9/1969 | Winans | 81/64 |
| 3,686,984 | 8/1972 | Kelso | 81/64 |
| 3,728,916 | 4/1973 | Brantley | 81/64 |
| 3,838,615 | 10/1974 | McFarland et al. | 81/64 |
| 4,114,481 | 9/1978 | Kowalczyk | 81/64 |
| 4,598,615 | 7/1986 | Tate | 81/64 |

*Primary Examiner*—D. S. Meislin

*Attorney, Agent, or Firm*—Allegretti & Witcoff, Ltd.

[57] ABSTRACT

An oil filter wrench comprises an elongated strap looped at each end and link means secured to the ends of the strap by sleeved cross pins. The strap has slots in the looped ends. The link means are positioned and retained in the slots by the sleeved cross pins.

6 Claims, 2 Drawing Sheets 52
6
48
18
14
50
46
16
38
64
66
32
34
62
60
20
68
70

OIL FILTER WRENCH

BACKGROUND OF THE INVENTION

This invention relates to an oil filter wrench and, more particularly, to an improved oil filter wrench having an elongated strap with looped ends joined to cross pins on a link, which cross pins carry sleeves thereon.

Oil filter wrenches are used in service stations to remove oil filters from an engine of a vehicle. In heavy duty applications, for example, for a truck, a large torque force is needed to loosen the dirty oil filter that is to be replaced and then to tighten the new replacement oil filter in place on the engine.

Various prior art filter wrenches are known. Winans U.S. Pat. No. 3,465,622 shows an oil filter wrench including an elongated adaptor rod interposed between the ratchet handle and a tension ring. Kelso U.S. Pat. No. 3,686,984 reveals an oil filter wrench having a flexible strap directly connected at its ends to jaw members which are pivoted at each end of a link member. Brantley U.S. Pat. No. 3,728,916 pertains to an oil filter wrench comprising a support, a cam member rotatably mounted on the support and a flexible strap attached at one end to the cam member and having a second end threaded therethrough. McFarland et al. U.S. Pat. No. 3,838,615 pertains to an oil filter wrench for heavy duty applications which has a band, a lever member, and an anchor having a curved plate and a pair of ears which support a cross pin that functions as the fulcrum for the lever member. Kowalczyk U.S. Pat. No. 4,114,481 reveals an oil filter wrench with a ratchet drive. Tate U.S. Pat. No. 4,589,615 discloses an oil filter wrench having an elongated strap secured at its ends to pins that are joined to a lever. None of these prior art references teaches the novel oil filter wrench which includes a link having cross pins with sleeves carried thereon, for operatively connecting the ends of an elongated strap adapted to be selectively secured to an oil filter casing for removing a dirty or damaged filter on an engine and replacing i with a new filter.

An object of this invention is to provide an improved oil filter wrench wherein disadvantages and deficiencies of prior known devices are obviated.

Another object of the present invention is to provide an improved oil filter wrench having an elongated strap formed with a loop at each end, each loop being connected to a link member by a pair of cross pins, each cross pin having a pair of sleeves carried thereon.

Another object of the present invention is to provide an oil filter wrench incorporating sleeves to transfer the load from cross pins carried on a link to the ends of the elongated strap or bend.

Yet another object of the present invention is to provide an improved oil filter wrench that includes a link cooperating with the looped ends of an elongated strap through sleeved cross pins, the components being constructed and arranged to provide a relatively low profile. Other objects and advantages of the present invention will be made more apparent hereafter.

BRIEF DESCRIPTION OF THE DRAWING

With reference to the attached drawings, there is shown a presently preferred embodiment of the present invention, wherein like numerals in the various views refer to like elements and wherein.

DETAILED DESCRIPTION OF THE PRESENT INVENTION

Figure 1:
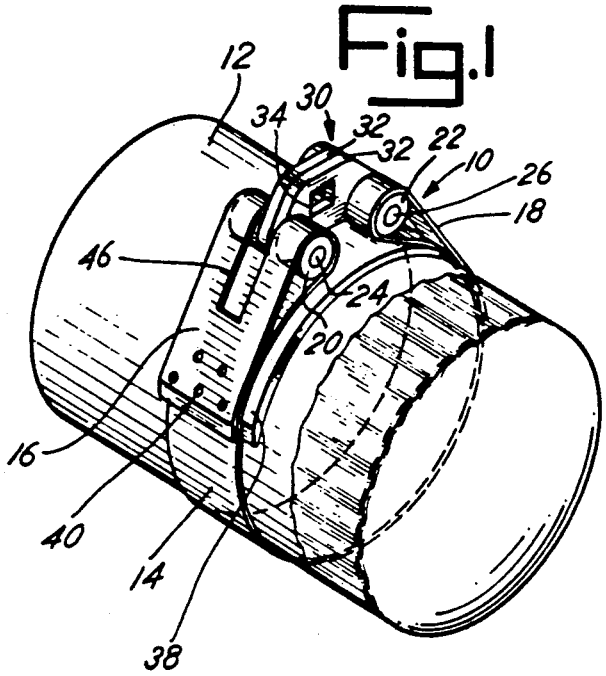
FIG. 1 is a perspective view illustrating the oil filter wrench of the present invention in place on a filter.

Referring to the drawings, there is shown in FIG. 1 an oil filter wrench 10 encircling an oil filter 12. The oil filter wrench 10 includes an elongated strap 14 adapted to encircle the oil filter 12 and operatively secured thereto in use to remove a dirty or damaged oil filter 12 from a vehicle engine and then to substitute a new oil filter 12 in place of the damaged oil filter. The ends of the oil filter wrench 12 are in the form of loops 16 and 18 that engage with pairs of sleeves 20 and 22 respectively carried on cross pins 24 and 26 that are secured to link means 30 comprised of like links 32. The links 32 have an opening 34 therethrough for receiving a torque tool or ratchet tool (not shown). A saddle 38 is secured to the elongated strap 14. The inner curvature of the saddle 38 corresponds substantially to the exterior surface of the housing of oil filter 12 to help distribute the load from the strap 14 over a larger surface area of the housing for the oil filter 12.

With reference to FIGS. 1-4, it is seen that the cross pins 24 and 26 are positioned in aligned openings in the links 32. The sleeves 20 and 22 of each pair are on opposite sides of the links 32.

The loops 16 and 18 of strap 14 are formed by bending the free ends of strap 14 upon themselves and then fastening the ends 16 and 18, respectively to the strap, for example, by rivets 40 and 42, respectively.

Figure 2:
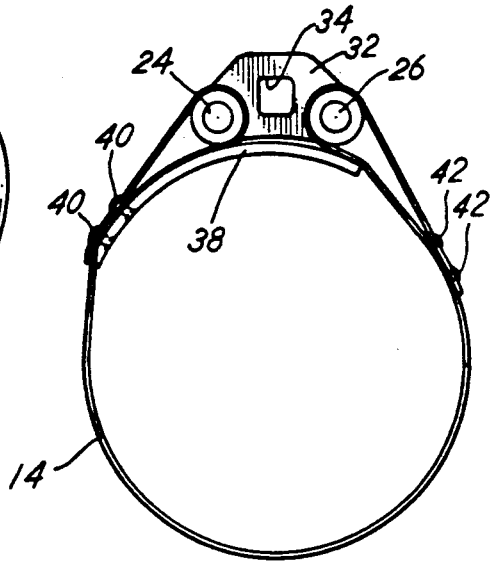
FIG. 2 is an elevation view of the oil filter wrench.
Figure 3:
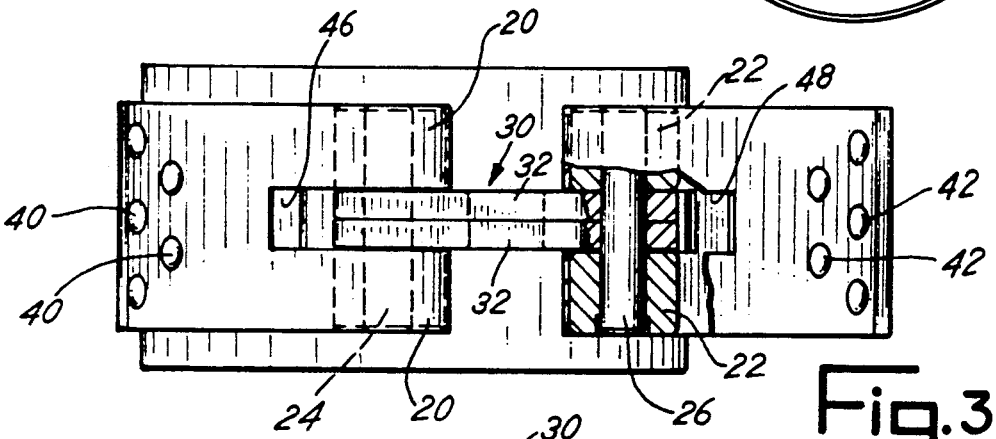
FIG. 3 is an enlarged plan view of the oil filter wrench, with parts broken away to better illustrate the sleeves.
Figure 4:
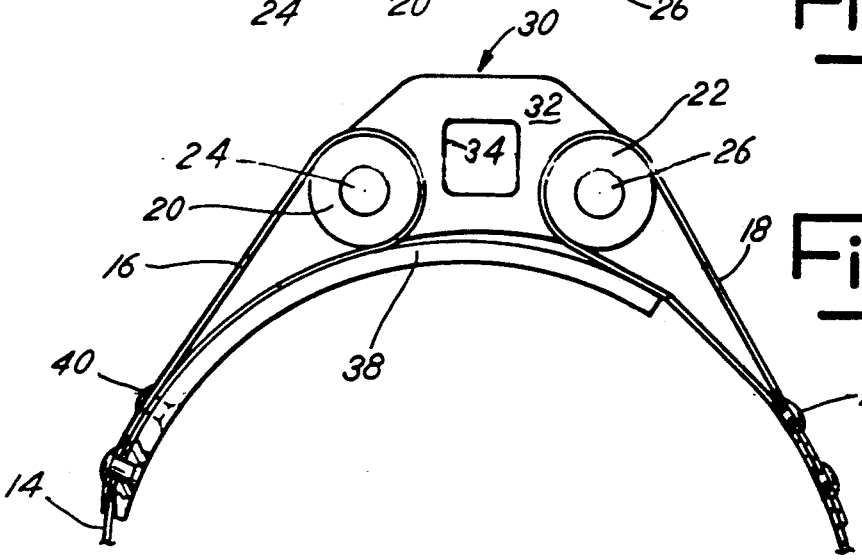
FIG. 4 is an enlarged partial elevation view of the oil filter wrench.

As seen in FIGS. 2 and 4, the rivets 40 secure saddle 38 to strap 14.

The strap 14 is provided with elongated slots 46 and 48 adjacent each end for receiving the links 32. The slots 46 and 48 are elongated longitudinally of the strap 14.

Figures 5, 6, 7, 8, 9, 10, 11, 12, 13:
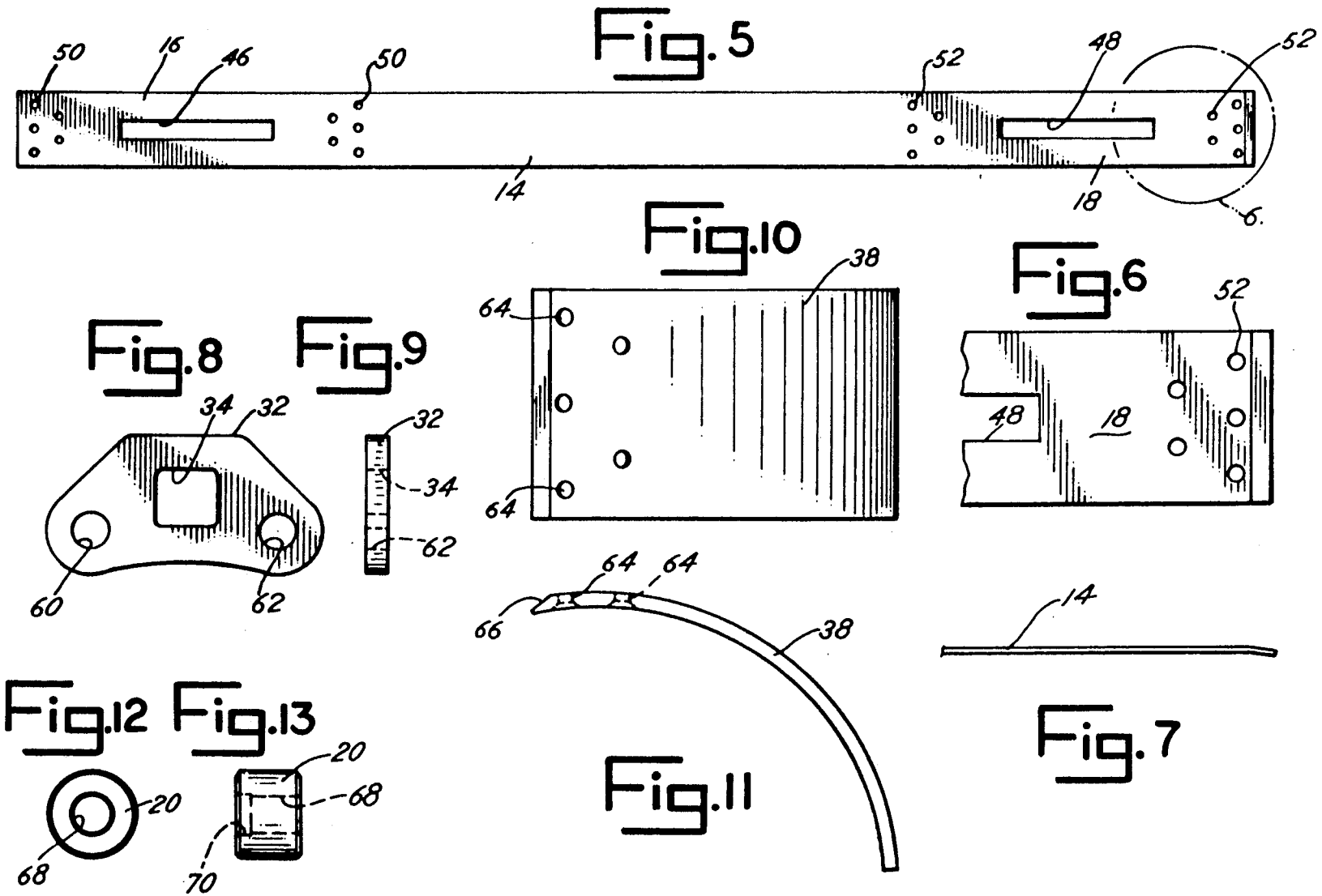
FIG. 5 is a plan view of the strap of the oil filter wrench.
FIG. 6 is an enlarged detail view of an end of the strap of FIG. 5.
FIG. 7 is a side detail view of the end of the strap of FIG. 5.
FIG. 8 is an elevation view of a link of the oil filter wrench.
FIG. 9 is a side view of the link of FIG. 8.
FIG. 10 is a plan view of the saddle of the oil filter wrench.
FIG. 11 is a side view of the saddle shown in FIG. 10.
FIG. 12 is an elevation view of a sleeve.
FIG. 13 is a side view of the sleeve of FIG. 12.

Turning to FIGS. 5, 6 and 7 there is better shown the strap 14. The strap 14 is made from a high tensile strength metal such as steel. The thickness of the strap 14 is as small as possible to enable the strap 14 to better adapt to the shape of an oil filter in use. The thinner the material of the strap, the easier the starting process of securing the oil filter wrench 10 to an oil filter. Presently, it is preferred that the band thickness be on the order of .030 inch - .033 inch. Fastening openings 50 and 52 are provided in the ends 16 and 18, respectively, of the strap 14. The longitudinally elongated slot 46 lies between the openings 50 and the longitudinally elongated slot 48 lies between the openings 52.

FIGS. 8 and 9 better show a link 30. The link 30 is formed from metal, for example, a hardened and tempered carbon steel. Opening 34 is formed centrally in the link 32. Opening 34 is non-circular, preferably square as shown, for receiving a ratchet or like torque tool. The openings 60 and 62 are adapted to receive the cross pins 24 and 26 (FIGS. 1-4) loosely, i.e., the diameter of openings 60 and 62 is slightly larger than the diameter of the cross pins. In one presently preferred embodiment, the diameter of the cross pin is about .3125 inch and the diameter of the holes 60 and 62 is about .317 inch.

Saddle 38 (FIGS. 10 and 11) is formed from metal, for example, a carbon steel strip. Holes 64 are provided at one end of the curved saddle 38 to permit rivets to pass therethrough to secure the saddle 38 to strap 14. The holes 64 are countersunk so that the heads of the rivets 40 may be flush with the inner surface of the saddle 38. The saddle 38 is generally curved and the inner surface thereof is adapted to be complementary in shape to the outer surface of an oil filter. The free end of the saddle 38 adjacent to the outer hole 64 is chamfered, as indicated at 66.

With reference to FIGS. 12 and 13, there is shown one sleeve 20. Each of the sleeves 20 and 22 is configured in the same fashion as the sleeve 20. Hole 68 is provided in sleeve 20. The hole 68 may be counterbored, as indicated at 70. Hole 68 has a slightly smaller diameter than the cross pins 24 and 26 for receiving a cross pin in a force fit relationship. For example, in one presently preferred embodiment the hole 68 has a diameter of about 0.3119 inch and the outside diameter of the cross pins 24 and 26 are about 0.3125 inch.

One method of assembling the oil filter wrench 20 of the present invention is comprised of the following steps. The strap or band 14 is fabricated as shown in FIG. 5, for example, by stamping same from sheet stock. The strap end 16 is bent on itself to form a loop. Holes 50 in the strap 14 are aligned with holes 64 in the saddle 38 and rivets 40 are secured in the holes. End 18 of strap 14 is bent to align holes 52 and rivets 42 are secured in the holes 52 to form a loop. One sleeve 20 is secured to cross pin 24. One sleeve 22 is secured to cross pin 26. The link means 30 is positioned in slots 46 and 48 in ends 16 and 18 of strap 14. Cross pins 24 and 26 are positioned in the loops in alignment with holes 60 and 62 in the link means. The second sleeve 20 and 22, respectively, are force fit onto cross pins 24 and 26 respectively and positioned to obtain the desired axial clearance.

The sleeves 20 and 22 are sued to transfer the load from the cross pins 24 and 26 to the ends 16 and 18 of the strap 14. The sleeves transmit the radial load of the saddle 38 and the tangential load to the loops at the ends of strap 14. Further, the sleeves 20 and 22 elevate the cross pins 24 and 26 off the saddle 38 thereby providing clearance for the link means 30 that surround the cross pins 24 and 26. In addition, the sleeves 20 and 22 enable the use of slotted, high strength loop type strap ends. The relatively large diameter sleeve arrangement also permits the drive to be located between the sleeves and gives a low profile. The present oil filter wrench avoids the need for "ears" on the saddle. Such "ears" would be required to be strong enough to handle the high pin loads involved in removing an oil filter from the engine. The pin loads involved in removing a stuck oil filter can be on the order of 1200 pounds.

In operation, the oil filter wrench 10 is positioned on an oil filter 12 as shown in FIG. 1. Torque is applied to rotate the link means 30 counter-clockwise as viewed in FIG. 1. The strap 14 would be frictionally "locked" to the oil filter and upon continued rotation the oil filter would be unscrewed from the engine. The oil filter wrench 10 can be sized for different size filters, as would be apparent to a person of ordinary skill in the art.

While a presently preferred embodiment of the invention has been shown and described, it is apparent that various changes and modifications may be made therein departing from the invention. Therefore, the claims are intended to cover all such changes and modifications as fall within the true spirit and scope of the invention.

What I claim is:

1. An oil filter wrench comprising an elongated strap made from high tensile strength material, each end of said elongated strap being formed with a loop, the elongated strap having longitudinally extending slots therein adjacent each end, a saddle secured to said elongated strap, link-means for cooperating with a torque applicator for applying force to the link means so as to tighten the elongated strap on an oil filter, said link means being disposed within said slots at each end of said elongated strap, a first cross pin secured to said link means, a first sleeve on said first cross pin, a second cross pin secured to said link means, a second sleeve on said second cross pin, one end of said elongated strap secured to said first cross pin over said first sleeve and the other end of said elongated strap secured to said second cross pin over said second sleeve, said sleeves transferring the load from the first and second cross pins to the loops of the elongated strap.

2. An oil filter wrench as in claim 1 wherein the link means has an opening extending transversely of the link means and between the first and second cross pins for receiving the torque applicator.

3. An oil filter wrench as in claim 1, wherein the first cross pin and the second cross pin each carry an additional sleeve to define a pair of sleeves on said first cross pin and on said second cross pin, the outer peripheries of the pairs of sleeves engaging the inner surfaces of the loops of the elongated strap.

4. An oil filter wrench as in claim 3 wherein the saddle is disposed adjacent the cross pins and sleeves in sue, with the sleeves elevating the cross pins from the saddle so as to provide clearance for the link means.

5. An oil filter wrench as in claim 1 wherein the link means comprise a pair of like links disposed adjacent to one another.

6. An oil filter wrench as in claim 3 wherein the two sleeves on the first cross pin are axially spaced on opposite sides of the link means and the two sleeves on the second cross pin are axially spaced on opposite sides of the link means.

* * * * *